US005504957A

United States Patent [19]

Lee

[11] Patent Number: 5,504,957

[45] Date of Patent: Apr. 9, 1996

[54] AUTOMATIC CLEANING DEVICE FOR TV GAME CASSETTE

[76] Inventor: Jeen-Ju Lee, No. 52, Lane 490, Jong-Jeng South Road, Yung-Kang Hsiang, Tainan Hsien, Taiwan

[21] Appl. No.: 444,544

[22] Filed: May 19, 1995

[51] Int. Cl.[6] ..... A46B 13/02

[52] U.S. Cl. ..... 15/21.1; 15/97.1; 360/128

[58] Field of Search ..... 15/21.1, 97.1, 15/DIG. 12, DIG. 13; 360/128

[56] References Cited

U.S. PATENT DOCUMENTS

| | | | |
|---|---|---|---|
| 4,107,810 | 8/1978 | Varni | 15/97.1 |
| 4,713,857 | 12/1987 | Cecil | 15/97.1 |
| 4,783,870 | 11/1988 | Yeung | 15/97.1 |
| 4,854,001 | 8/1989 | Mannheimer | 15/97.1 |
| 5,181,292 | 1/1993 | Aghachi | 360/128 |
| 5,201,093 | 4/1993 | Wells | 360/128 |

*Primary Examiner*—Timothy F. Simone
*Assistant Examiner*—Randall E. Chin
*Attorney, Agent, or Firm*—Morton J. Rosenberg; David I. Klein

[57] ABSTRACT

An automatic cleaning device for TV game cassettes, which is able to automatically clean the copper foil contacts of the TV game cassette many times. The cleaning device has a housing formed with insertion sockets for different types and specifications of TV game cassettes to insert thereinto. A motor is used to drive a cleaning arm to swing left and right so that a cleaning assembly disposed at an end of the cleaning arm can back and forth clean the copper foil contacts of the cassette. When the number of the cleaning times reaches a predetermined number, a cleaning time setting means works to cut off the power for the motor, making the cleaning assembly rested on a lateral portion of the housing so as to prevent the dirts from remaining on the contacts of the cassette and ensure the cleaning effect.

10 Claims, 18 Drawing Sheets

AUTOMATIC CLEANING DEVICE FOR TV GAME CASSETTE

BACKGROUND OF THE INVENTION

The present invention relates to an automatic cleaning device for TV game cassette, and more particularly to an automatic cleaning device which is used to automatically clean copper foil contacts of TV game cassette so as to ensure normal contact between the TV game cassette and TV game main frame.

The TV game has been the most popular entertaining measure for the past many years. Currently, the volume of the TV game is greatly reduced and portable TV game is widely developed. Various kinds of TV game cassettes are commercially available to provide different types of games for a consumer. Many TV game manufacturers produce different TV game main frames and cassettes with different specifications. Therefore, in order to enjoy playing all kinds of TV games, a player must purchase all these TV game main frames and cassettes. However, no matter how the specifications of these cassettes are different from each other, such cassettes have similar structures. That is, each cassette includes a plastic cartridge and a printed circuit board enclosed therein. Integrated circuits recorded with TV game programs are inserted on the circuit board and many copper foil contacts are printed on one edge of the circuit board. The contacts protrudes out of an insertion socket of the cartridge for inserting into and electrically contacting with the connector of the TV game main frame so as to load the TV game programs of the cassette thereinto. Accordingly, a player can play the TV game through a monitor.

Because the copper foil contacts of the cassette protrude out of the insertion socket thereof and are frequently inserted into or withdrawn from the connector, the copper foil contacts are apt to be contaminated by dusts or dirts which will seriously affect the contacting effect. Therefore, it is necessary to timelily clean the copper foil contacts.

FIG. 22 shows a conventional manually operated cleaner 130 which is used to clean up the copper foil contacts of the TV game cassette. Such cleaner 130 includes a thin plastic tongue plate 131 covered by a cleaning member 132 and a handle 134. When used, a user must hold the handle 134 with fingers and extend the cleaning member 132 into the insertion socket of the cassette to reciprocally wipe the copper foil contacts.

According to the above arrangements, several shortcomings exist as follows:

1. It is laborious, inconvenient and time-wasting to the player to clean the contacts with such cleaner.
2. The player can hardly uniformly exert a force on the cleaner so that it is difficult to achieve an evenly cleaning effect.

Therefore, it is necessary to provide an improved cleaning device for the TV game cassette to eliminate the above shortcomings.

SUMMARY OF THE INVENTION

It is therefore a primary object of the present invention to provide an automatic cleaning device for TV game cassettes, which is able to automatically clean the copper foil contacts of the TV game cassette many times. According to the above object, the cleaning device includes a housing composed of an upper case and a lower case. The upper case includes at least one insertion socket formed on a surface thereof, whereby the cassette can be inserted and located in the insertion socket, and at least one linear guide rail formed in the housing corresponding to the insertion socket; at least one cleaning assembly which can be a brush made of hairs and which is slidably disposed on the guide rail, the cleaning assembly being able to reciprocally sliding along the guide rail to back and forth clean contact portions of the cassette; a cleaning arm having one end pivotally disposed in the housing and another end slidably connected with the cleaning assembly, the cleaning arm being formed with slide slots; a crank having a rotary center and a driving section, the rotary center being rotatably disposed in the housing, the driving section being slidably connected with the slide slots of the cleaning arm, whereby by means of the rotation of the crank, the cleaning arm is driven to reciprocally swing so as to drive the cleaning assembly to reciprocally move along the guide rail; and a motor disposed in the housing for driving the crank to rotate.

In a preferred embodiment of the present invention, the housing includes two insertion sockets for different types of TV game cassettes to insert thereinto.

Several locating tenons are further disposed in one or both of the insertion sockets. The locating tenons are positioned in the housing and extended into the insertion sockets for engaging with one or two ends of a relatively small TV game cassette. The locating tenons have inclined sides, whereby a relatively large TV game cassette can press said inclined sides of the locating tenons to retract the same into the housing, so that the larger TV game cassette can be smoothly inserted into the insertion sockets and securely located therein by means of a tightening effect provided by the locating tenons.

The locating tenons have resilient portions integrally formed on the locating tenons. One of the resilient portions is fixed in the housing, making the locating tenon resiliently biased toward the insertion sockets.

In another preferred embodiment of the present invention, the cleaning device further comprise a cleaning time setting means including a switch fixedly disposed in the housing for controlling activation/stopping of the motor; a cam rotatably disposed in the housing and adjacent to the switch for controlling closing/opening thereof; and a transmission gear disposed between the cam and the crank for setting rotary speed ratio therebetween. The cam is disk-like and disposed on the crank, having a large diameter rim portion and a small diameter rim portion. A spring is disposed between the cam and the lower case for lifting the cam. The bottom of the upper case is formed an annular projection corresponding to a rotational track of the crank. A recess is formed on the annular projection, whereby the driving section of the crank is able to upward abut against the projection to force the crank and cam to move downward so that the large diameter rim portion of the cam can trigger the switch. The recess of the projection permits the driving section of the crank to slide thereinto, whereby by means of the spring, the cam and crank are lifted to make the small diameter rim portion of the cam aligned with the switch so as to cut off power for the motor and thus rest the cleaning assembly at the ends of the guide rails.

The transmission gear has a lifting portion for lifting or lowering the cam and the driving section of the crank.

The cleaning arm includes two arm members pivotally connected with each other and a torsion spring disposed between the two arm members, whereby when the cleaning arm is folded for relatively short travel cleaning operation and unfolded for relatively long travel cleaning operation.

The advantages of the present invention are as follows:

1. The cleaning assembly can automatically back and forth clean the contacts of the cassette many times.
2. After the cleaning operation is completed, the cleaning assembly is automatically rested on a lateral portion of the housing so as to prevent the dirts from remaining on the contacts of the cassette and ensure the cleaning effect.
3. The cleaning device is able to clean various types and specifications of TV game cassettes.

The present invention can be best understood through the following description and accompanying drawing, wherein:

DETAILED DESCRIPTION OF THE PREFERRED EMBODIMENT

Figure 1:
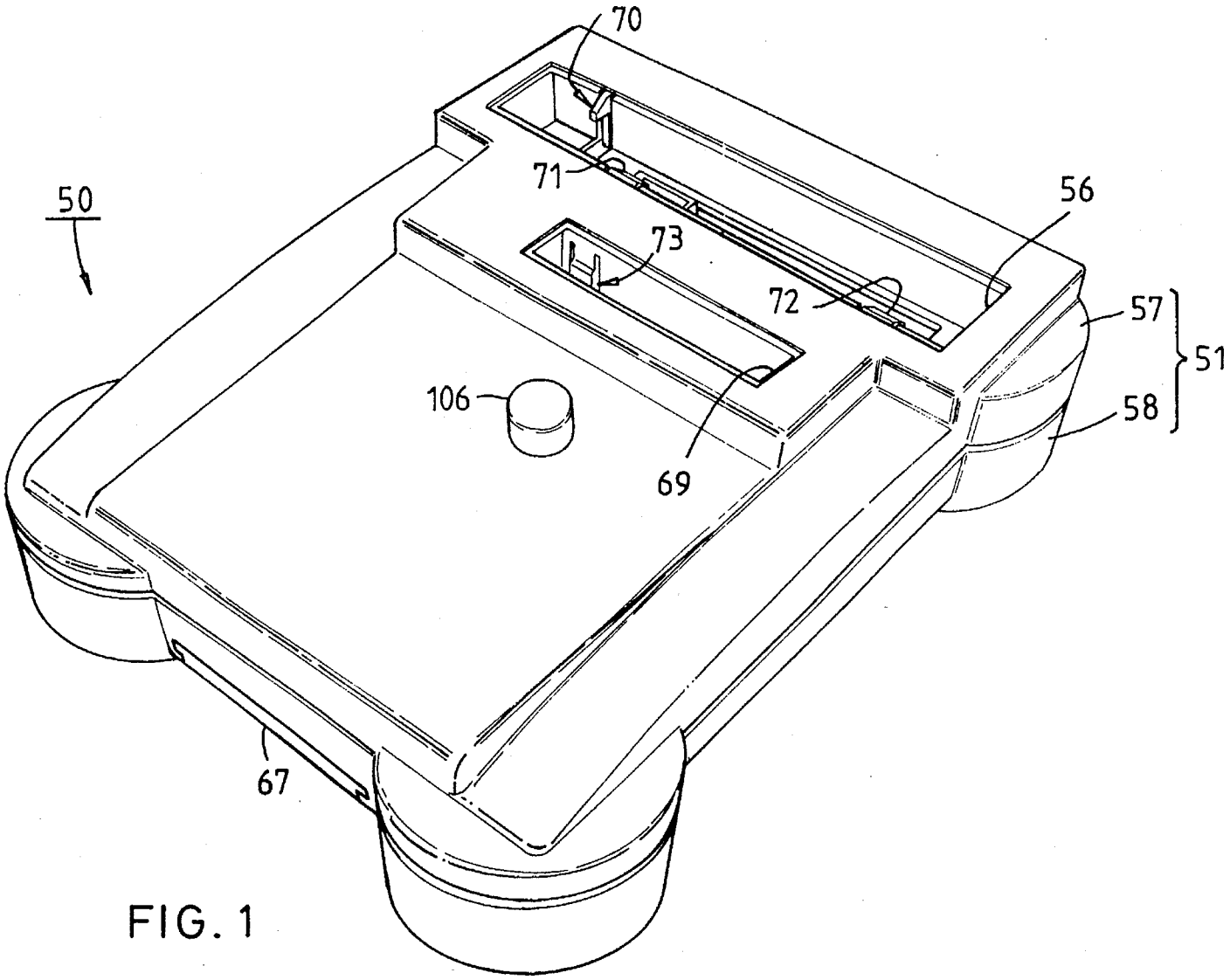
FIG. 1 is a perspective view of the present invention.
Figure 2:
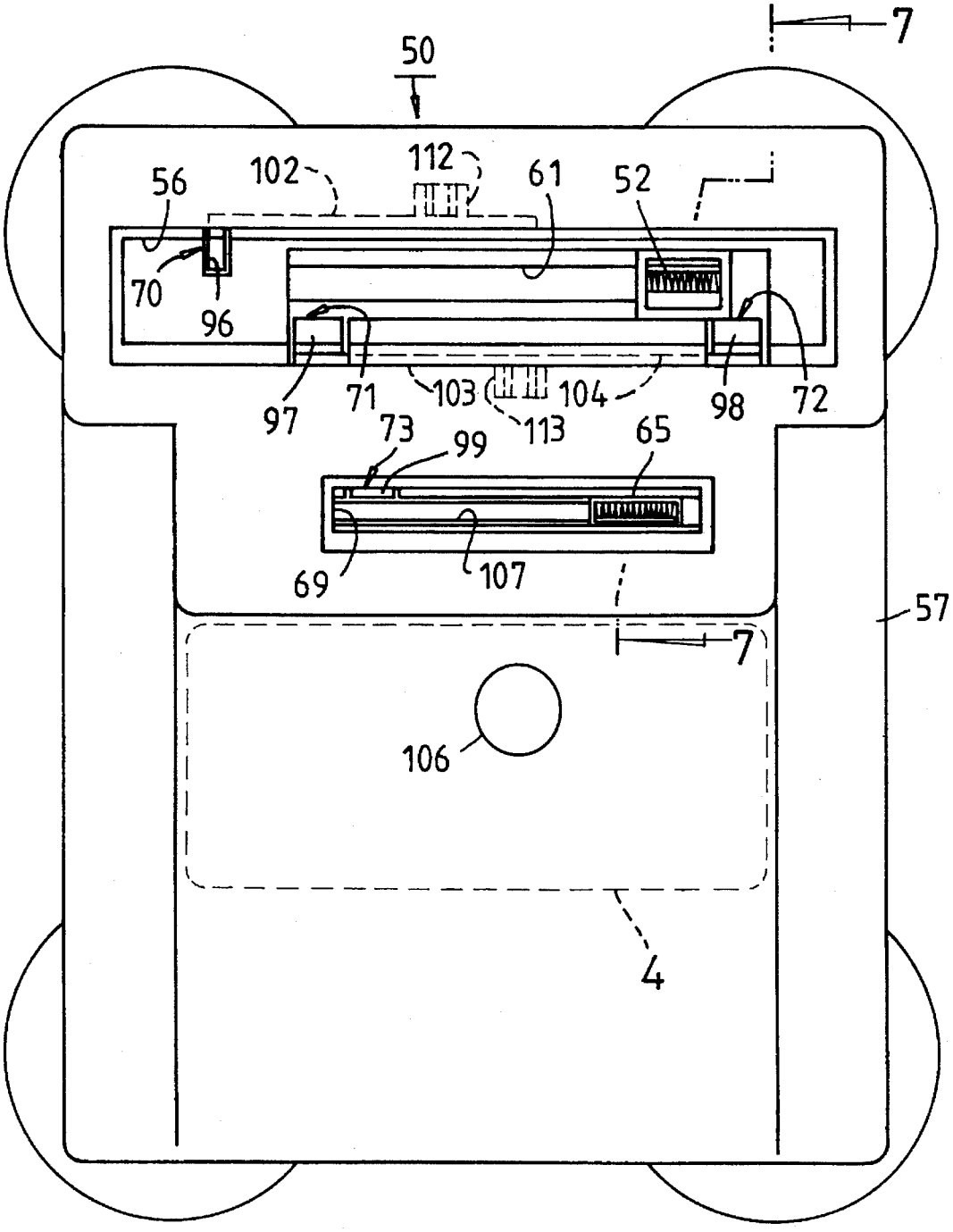
FIG. 2 is a top view of the present invention.

Please refer to FIGS. 1 to 7. The automatic cleaning device 50 of the present invention includes a housing 51, two cleaning assemblies 52, 65, a cleaning arm 53, a crank 54 and a motor 55. The housing 51 consists of an upper case 57 and a lower case 58. The upper case 57 includes two (at least one) cassette insertion sockets 56, 69 formed on the surface of the upper case 57, whereby different kinds of TV game cassettes 91, 92, 93, 94, 95 as shown in FIGS. 17, 18, 19, 20, 21 can be inserted and located therein to form the states as shown in FIGS. 12, 13, 14, 15, 16.

Please refer to FIGS. 3, 7, 10 and 11. The lower case 58 has two (at least one) linear guide rails 61, 107 formed inside the lower case 58 corresponding to the insertion sockets 56, 69 respectively.

The cleaning assemblies 52, 65 are slidably disposed on the guide rails 61, 107 and extended into the insertion sockets 56, 69 respectively. The cleaning assemblies 52, 65 can reciprocally move along the guide rails 61, 107 to clean the contacts 60 of the TV game cassettes 91, 92, 93, 94, 95 of FIGS. 12 to 16.

Figure 7:
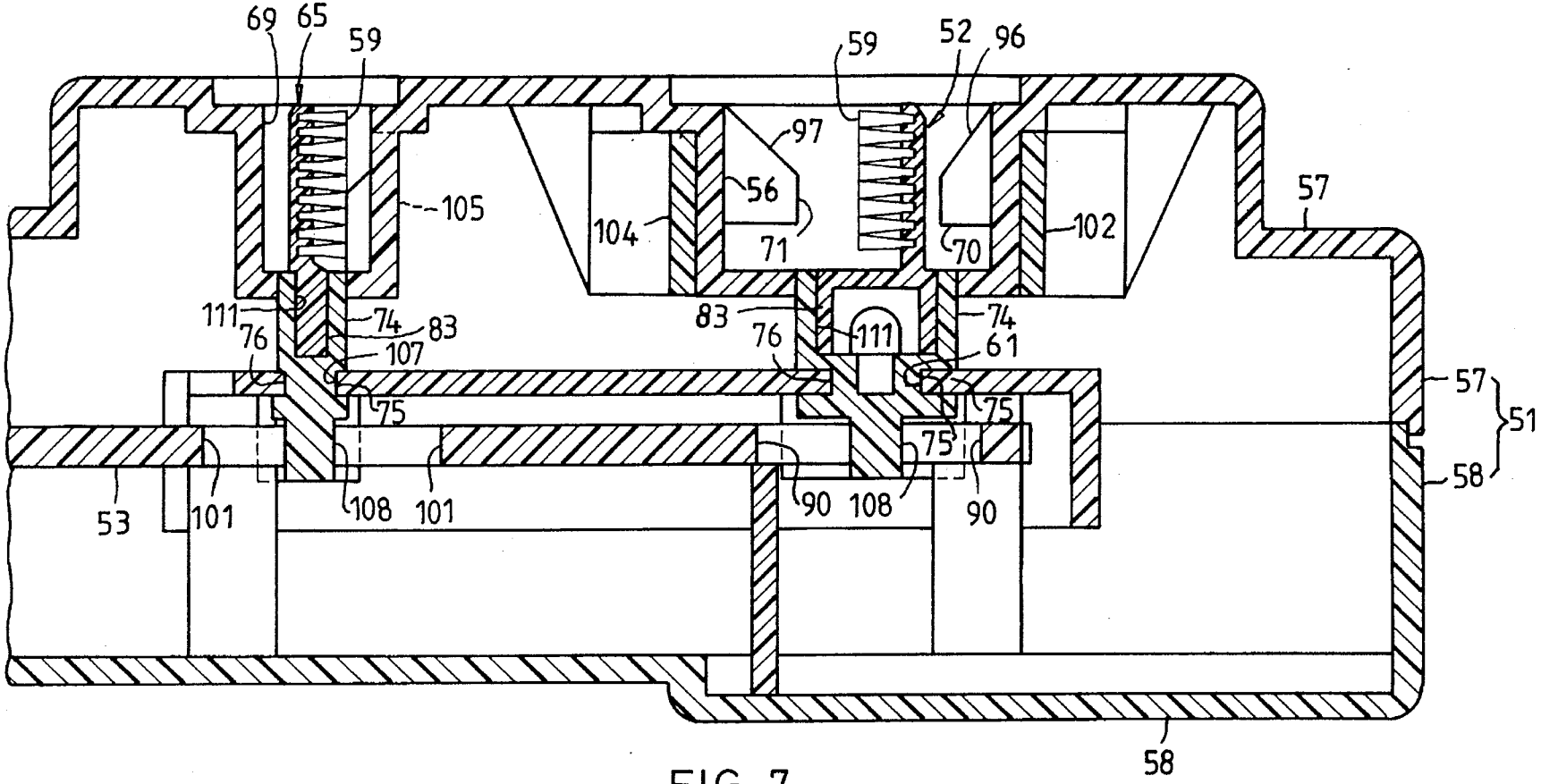
FIG. 7 is a sectional view taken along line 7—7 of FIG. 2.

Please refer to FIG. 7. Each cleaning assembly 52, 65 includes a slide seat 74 and a cleaning member 59. Two slide channels 75, 76 are formed on two lateral sides of the slide seat 74. The guide rails 61, 107 are slidably fitted in the slide channels 75, 76. The cleaning member 59 has an insertion section 83 inserted in an insertion receptacle 111 of the slide seat 74. Therefore, once the cleaning member 59 is contaminated, the same can be taken out and replaced by a clean one. In a preferred embodiment of the present invention, the cleaning member 59 is a brush made of hairs or other materials such as unwoven fabrics.

Figure 3:
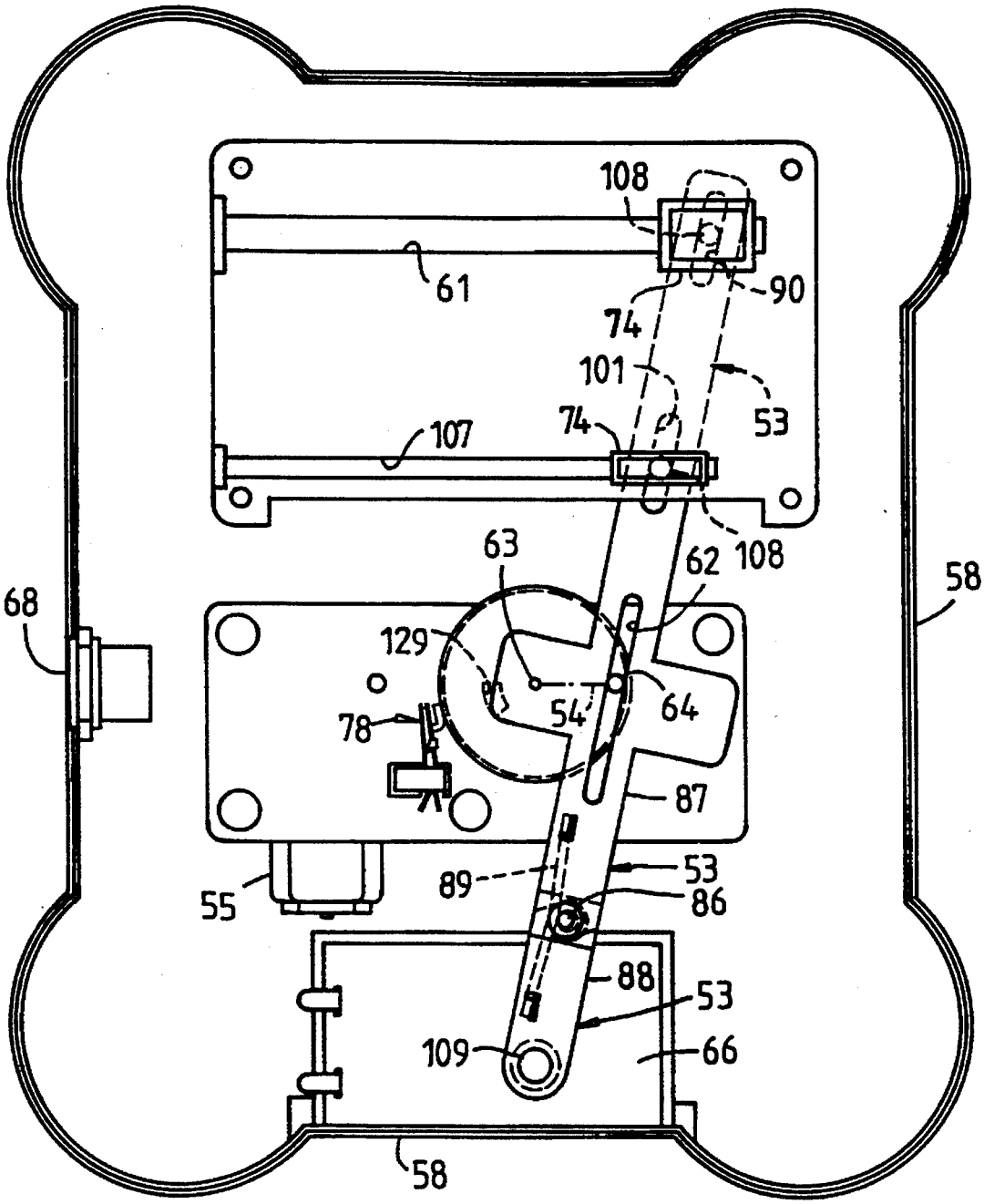
FIG. 3 is a top view according to FIG. 2, wherein the upper case is removed.

Please refer to FIGS. 3 and 7, one end of the cleaning arm 53 is pivotally disposed in the lower case 58 via a pivot pin 109, while the other end thereof is slidably connected under the cleaning assemblies 52, 65. The cleaning arm 53 has three slide slots 62, 90, 101, wherein the slots 90, 101 are respectively slidably and pivotally connected with two pin members 108 under the slide seats 74. The cleaning arm 53 can simultaneously drive the pin members 108 through the slide slots 90, 101, making the cleaning assemblies 52, 65 reciprocally slide respectively along the linear guide rails 61, 107 at the same time for back and forth performing the cleaning operation. The other slide slot 62 of the cleaning arm 53 is slidably and pivotally connected with an upper driving section 64 of the crank 54.

The cleaning arm 53 further includes two arm members 87, 88 pivotally connected with each other via pivot pins 86 and a torsion spring 89 disposed between the arm members 87, 88, whereby when the cleaning arm 53 travels through a relatively short distance to clean a smaller TV game cassette, the cleaning arm can be folded for a shorter cleaning travel. However, the cleaning arm 53 will not be folded with respect to a longer cleaning travel.

Figure 4:
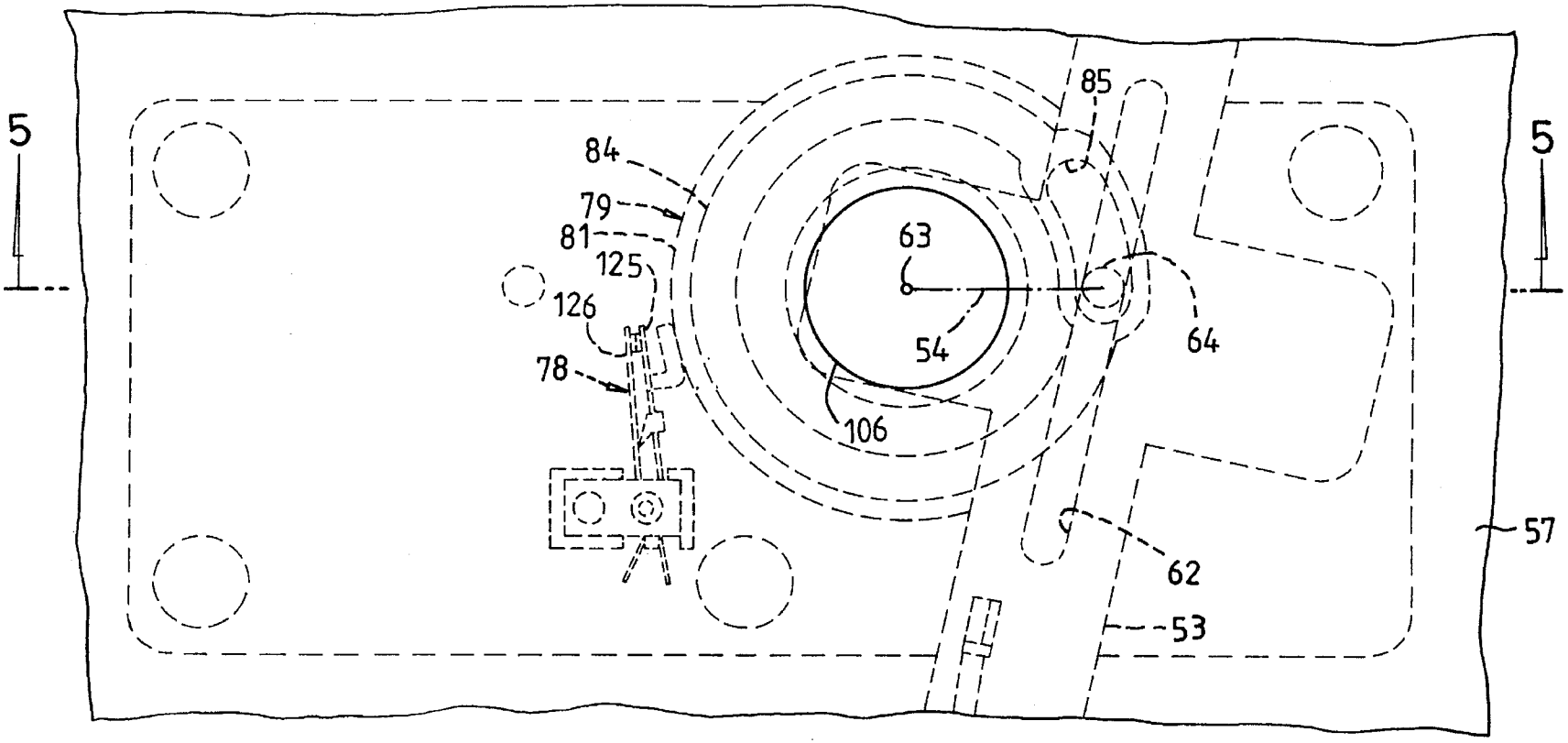
FIG. 4 is an enlarged view of the area 4 encircled by phantom line of FIG. 2.
Figure 5:
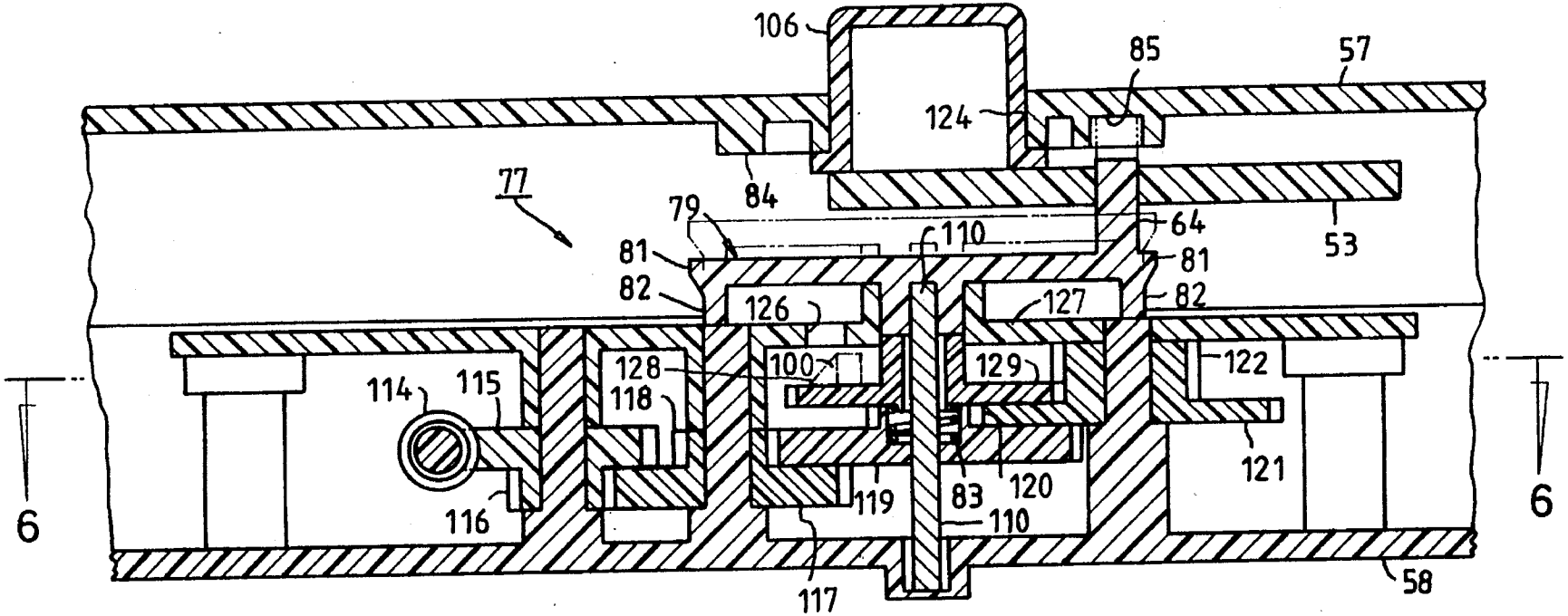
FIG. 5 is a sectional view taken along line 5—5 of FIG. 4.

Please refer to FIGS. 3, 4 and 5. The crank 54 includes a rotary center 63 and a driving section 64. The rotary center 63 is rotatably disposed on the lower case 58 through a shaft member 110. The driving section 64 is slidably and pivotally connected with the slide slot 62 of the cleaning arm 53. By means of the rotation of the crank 54, the cleaning arm 53 is driven to reciprocally swing so as to further drive the cleaning assemblies 52, 65 to reciprocally move along the guide rails 61, 107.

Figure 6:
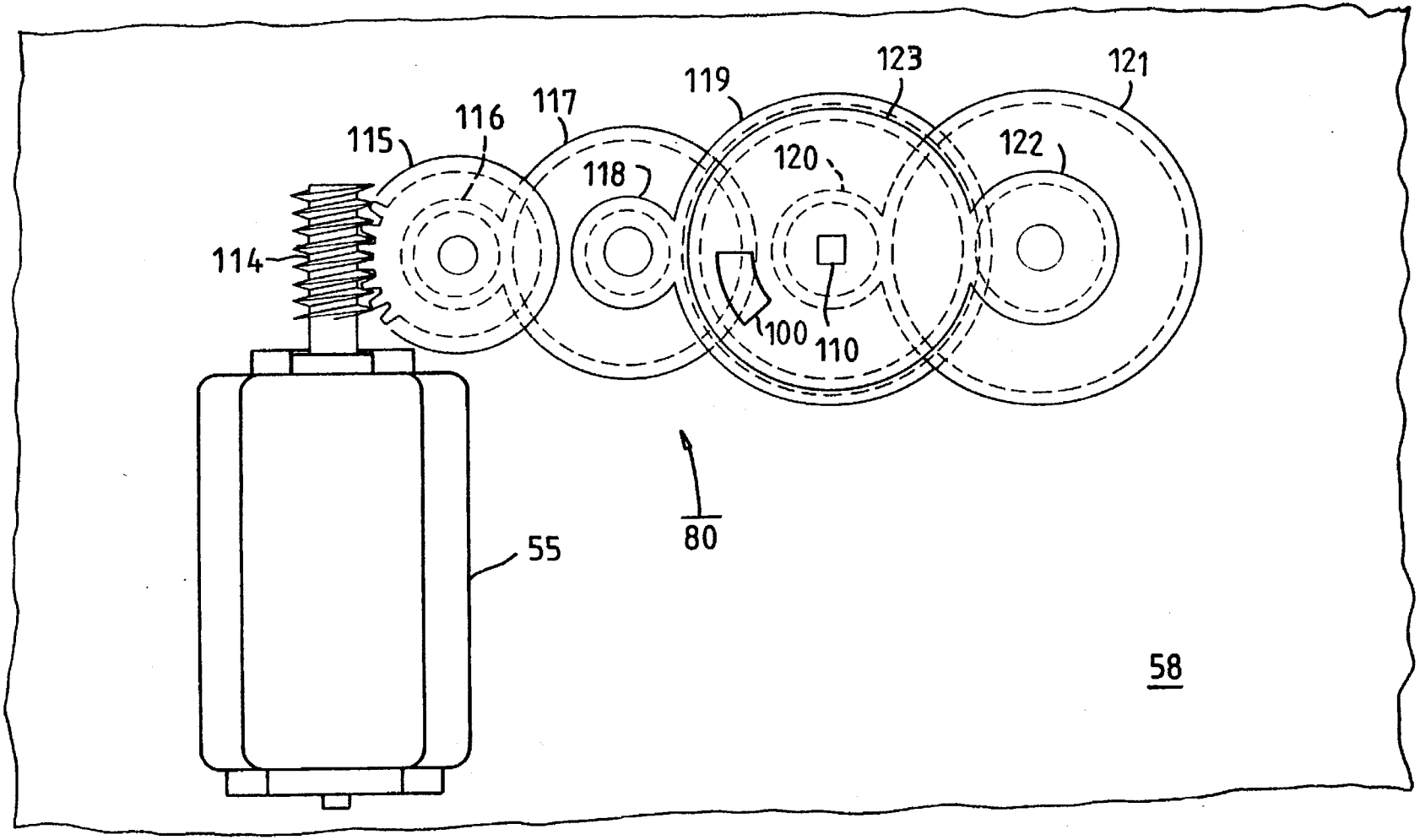
FIG. 6 is a sectional view taken along line 6—6 of FIG. 5.

Please refer to FIGS. 3 and 6. The motor 55 is disposed in the lower case 58 for driving the crank 54 to rotate and make the cleaning assemblies 52, 65 reciprocally move along the linear guide rails 61, 107 for back and forth cleaning the contacts 60 of the TV game cassettes 91, 92, 93, 94, 95 as shown in FIGS. 12 to 16.

Please refer to FIGS. 1 and 3. A cell box 66 and a cell cover 67 are disposed on the bottom of the lower case 58 for containing a cell to supply the power for the motor 55. Alternatively, the cleaning device can be connected to civil power supply through a DC socket 68 and an adapter.

Please refer to FIGS. 1, 2, 7, 8, 9, 12, 13, 14, 15 and 16. Various kinds and specifications of TV game cassettes can be inserted and located in the two (or more) insertion sockets 56, 69 of the upper case 57.

Please refer to FIGS. 2, 12, 13, 14, 15 and 16. In one or both of the insertion sockets 56, 69 are further disposed locating tenons 70, 71, 72 and 73 having resilient portions 102, 103, 104, 105. One end of each of the resilient portions 102, 103, 104, 105 is integrally formed on the locating tenons 70, 71, 72, 73 respectively. The other ends of the resilient portions 102, 103, 104 have fixing sections 112, 113 fixed in the upper case 57. The other resilient portión 105 is directly integrally connected with the upper case 57 as shown in FIGS. 2, 12, 13, 14, 15 and 16, making the locating tenons 70, 71, 72, 73 resiliently biased toward the insertion sockets 56, 69. The locating tenons 70, 71, 72, 73 are positioned in the upper case 57 and extended into the insertion sockets 56, 69 for latching one end (or two ends) of the relatively small TV game cassettes 92, 93, 94.

The locating tenons 70, 71, 72, 73 have inclined sides 96, 97, 98, 99, whereby the relatively large TV game cassettes 91, 92, 93 can press the inclined sides of the locating tenons 70, 71, 72, 73 to retract the same into the upper case 57, whereby the larger TV game cassettes 91, 92, 93 can be smoothly inserted into the insertion sockets 56, 69 and securely located therein by means of the tightening effect provided by the locating tenons 70, 71, 72, 73.

Please refer to FIGS. 4, 5 and 6. The cleaning device of the present invention further includes a cleaning time setting means 77 which includes a switch 78, a cam 79 and a transmission gear set 80. The switch 78 is fixedly disposed in the lower case 58 for controlling the activation/stopping of the motor 55.

The cam 79 is rotatably disposed in the lower case 58 and adjacent to the switch 78 for controlling the opening/closing thereof.

The transmission gear set 80 is disposed between the cam 79 and the crank 54 for setting the rotary speed ratio therebetween, whereby each time the cam 79 rotates through a set number of circles, the switch 78 is triggered to cut off the power for the motor 55. The transmission gear set 80 includes a spiral rod 114, a spiral wheel 115 and gears 116, 117, 118, 119, 120, 121, 122, 123. The motor 55 sequentially drives the spiral rod 114, spiral wheel 115 and gears 116, 117, 118, 119 to rotate and further drives the cam 79 to rotate via the gear 119 and driving shaft 110. Also, through the gear 119, the motor 55 further sequentially drives the gears 121, 122 to make the gear 123 rotate at a relatively slow speed. That is, each time the cam 79 rotates through certain circles, the gear 123 rotates through only, one circle. The gear 123 is not driven by the driving shaft 110 and is rotated relative to the driving shaft 110.

The cam 79 is disk-like and disposed on the crank 54, having two rim portions 81, 82 with different diameters. A spring 83 is disposed between the cam 79 and the lower case 58 to ascend the cam 79.

On the bottom of the upper case 57 is formed an annular projection 84 corresponding to the rotational track of the crank 54. A recess 85 is formed on a portion of the projection 84. The driving section 64 of the crank 54 upward abuts against the projection 84 to force the crank 54 and cam 79 to move downward, whereby the large diameter rim portion 81 of the cam 79 can trigger the switch 78. The recess 85 of the projection 84 permits the driving section 64 of the crank 54 to slide thereinto. By means of the spring 83 and a lifting section 100 disposed on the gear 123, the cam 79 and the driving section 64 are forced to ascend, whereby the small diameter rim portion 82 of the cam 79 is aligned with the switch 78 to separate two resilient contacts 125, 126 thereof from each other so as to cut off the power for the motor 55. Accordingly, the cleaning assemblies 52, 65 are rested at the ends of the guide rails 61, 107 respectively.

Please refer to FIGS. 1 to 5. The upper case 57 is disposed with a through hole 124 for a depression key 106 to pass therethrough to contact with the cleaning arm 53. Becasue the cleaning arm 53 is resilient, when the depression key 106 is depressed, through the cleaning arm 53, the cam 79 and the gear 123 are both pressed downward. While when the depression key 106 is released, the same is lifted by the resilient force of the cleaning arm 53.

Figure 8:
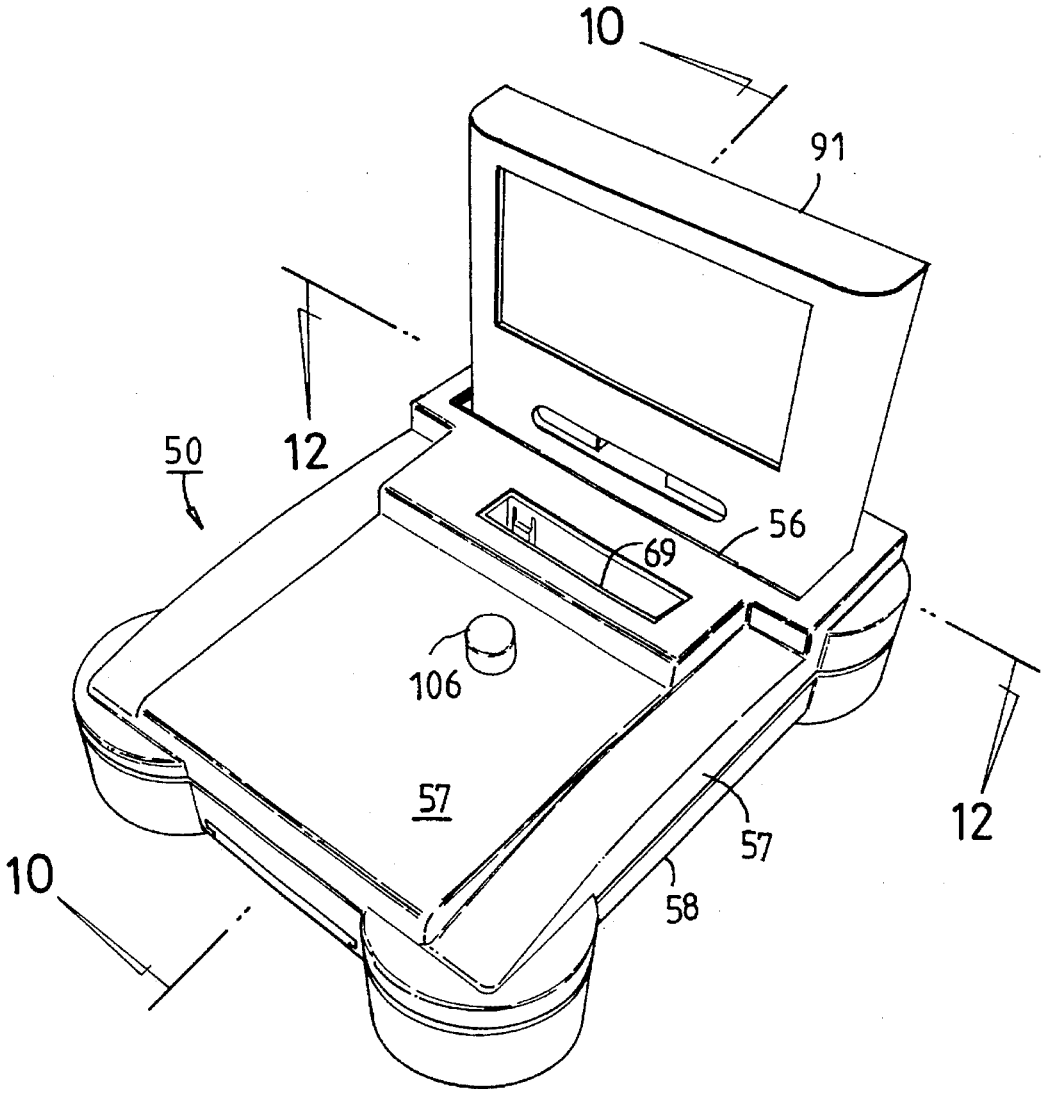
FIG. 8 is a perspective view showing that a first kinds of TV game cassette as shown in FIG. 17 is inserted into the cleaning device of the present invention.
Figure 9:
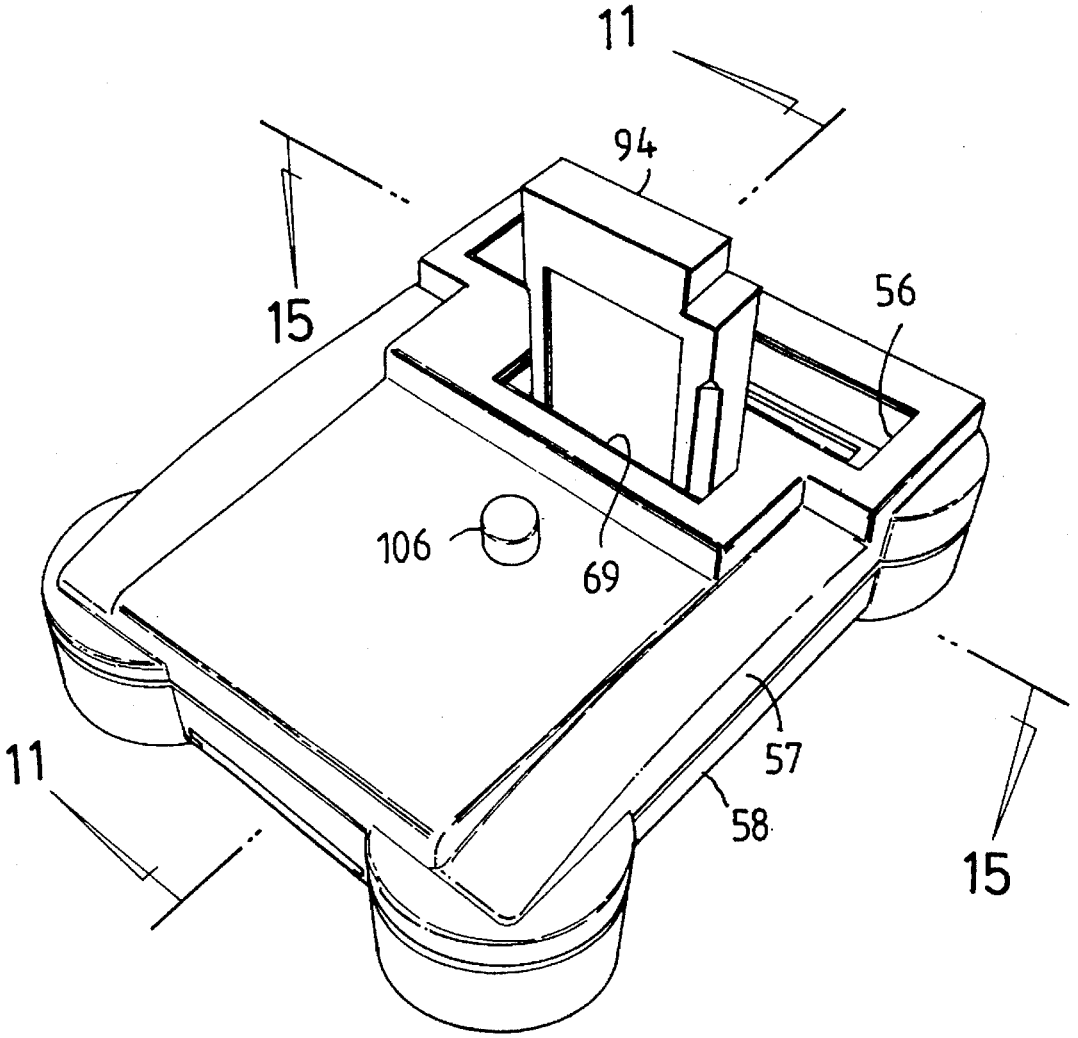
FIG. 9 is a perspective view showing that a fourth kinds of TV game cassette as shown in FIG. 20 is inserted into the cleaning device of the present invention.
Figure 10:
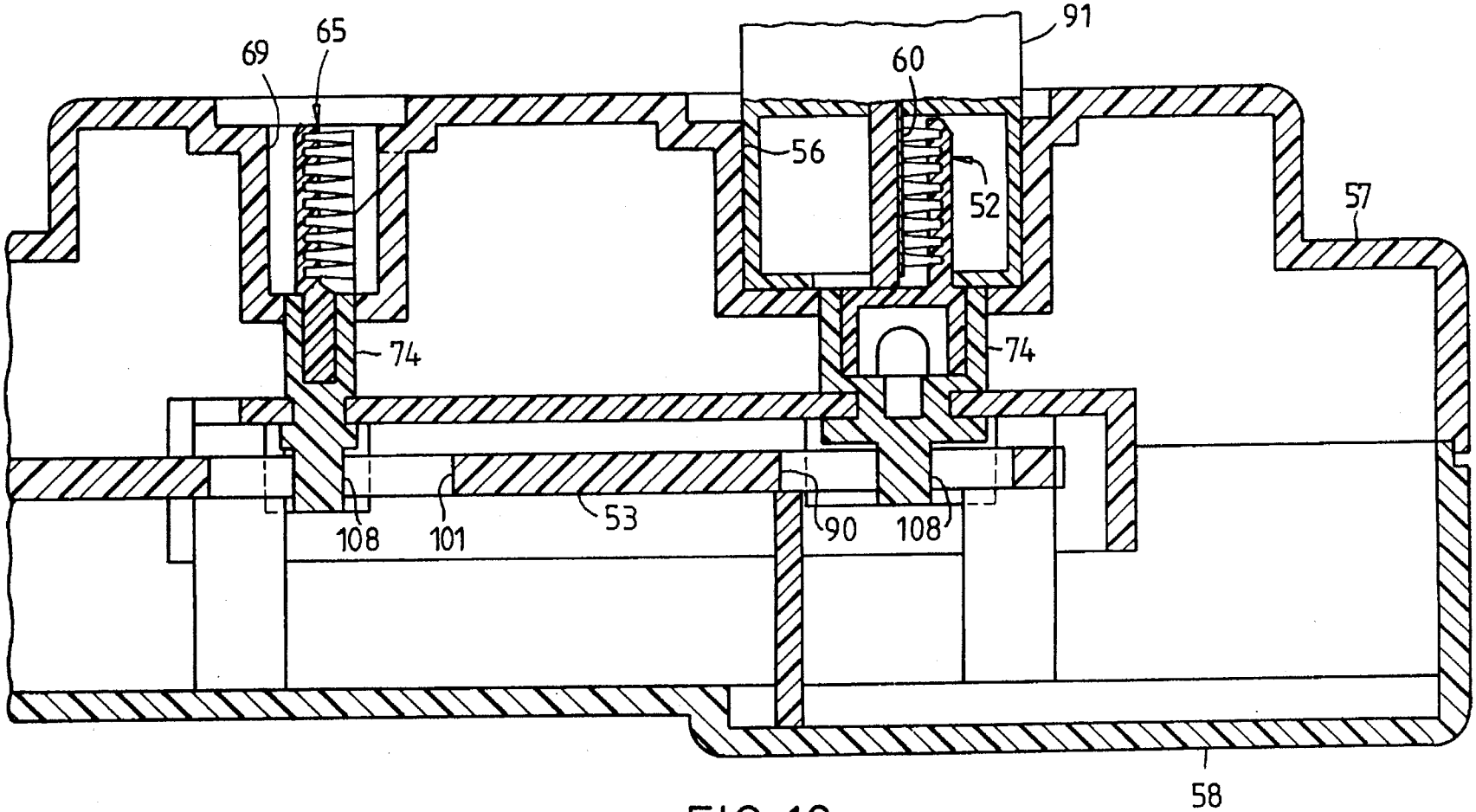
FIG. 10 is a sectional view taken along line 10—10 of FIG. 8.
Figure 11:
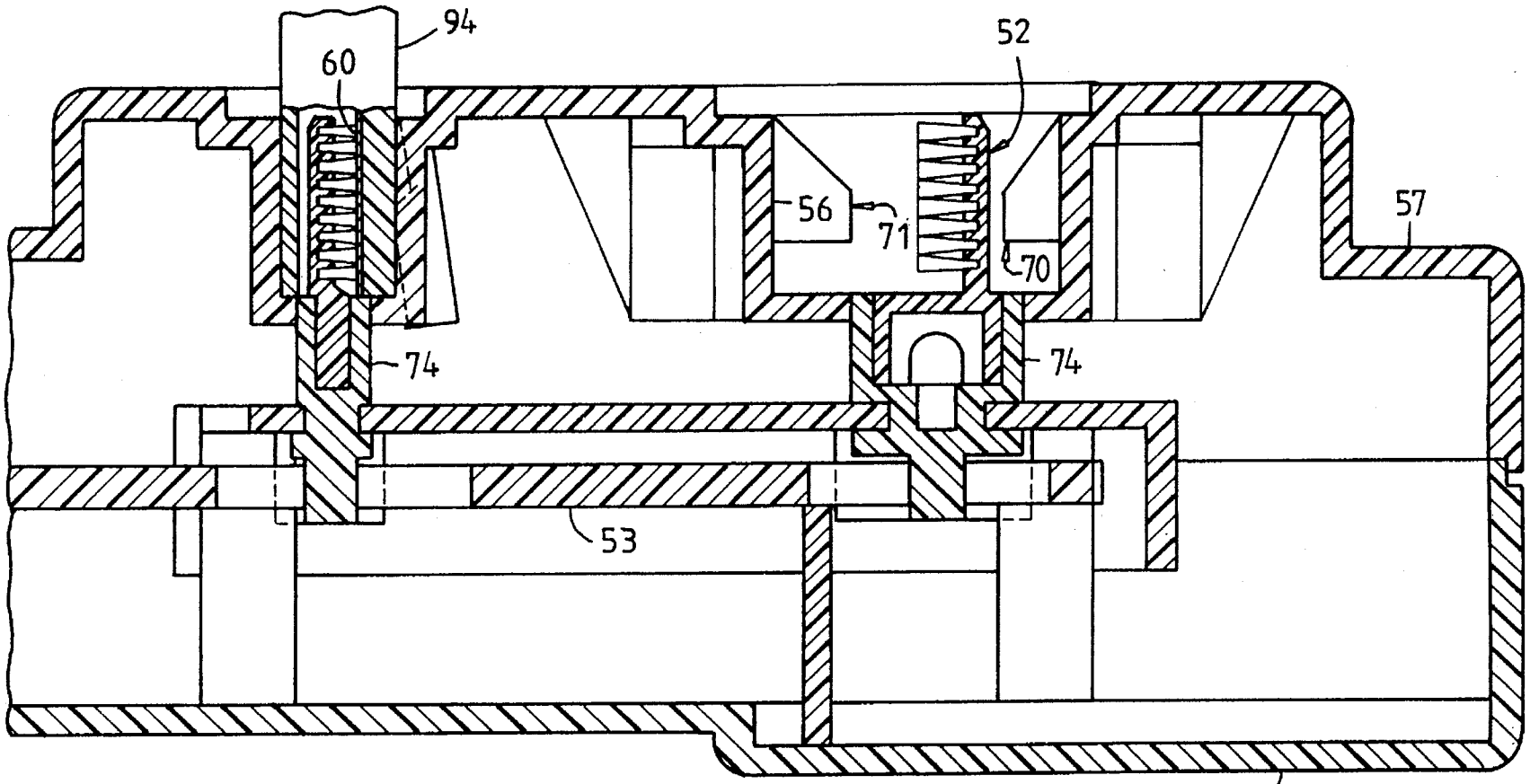
FIG. 11 is a sectional view taken along line 11—11 of FIG. 9.
Figure 12:
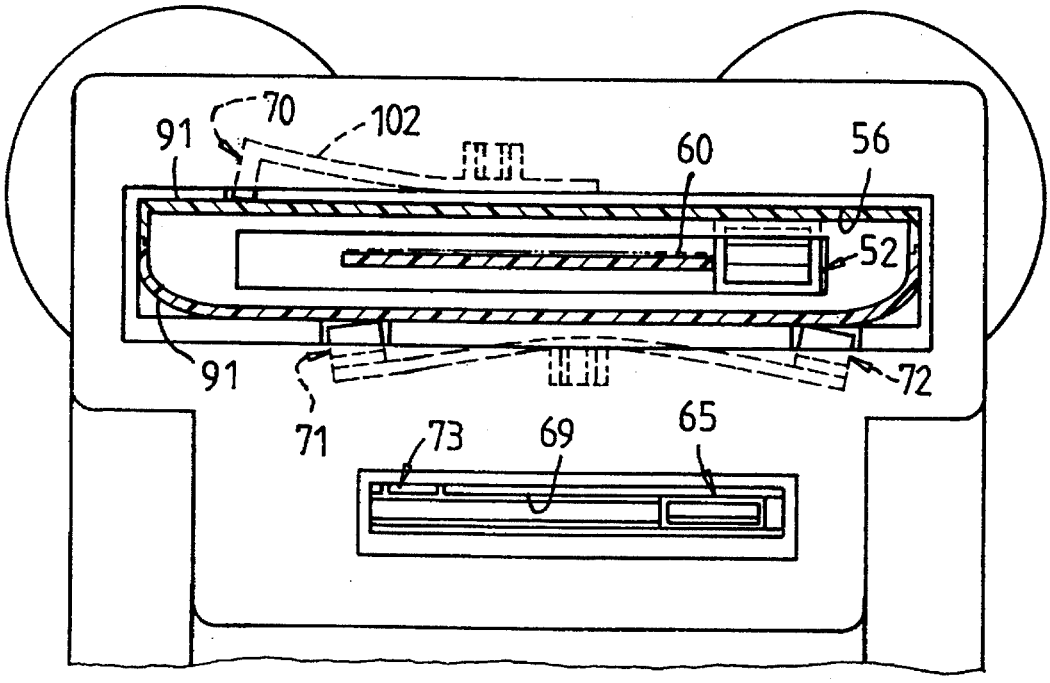
FIG. 12 is a sectional view taken along line 12—12 of FIG. 8, wherein the first kinds of TV game cassette of FIG. 17 is inserted into the cleaning device of the present invention.
Figure 13:
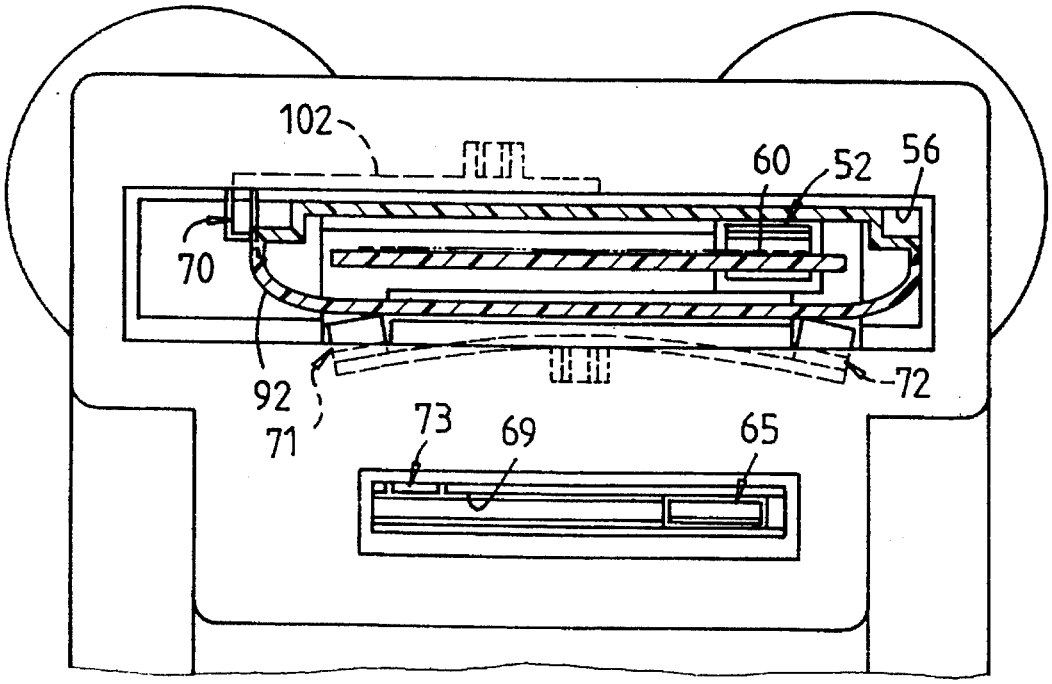
FIG. 13 is a sectional view showing that a second kinds of TV game cassette as shown in FIG. 18 is inserted into the cleaning device of the present invention.
Figure 14:
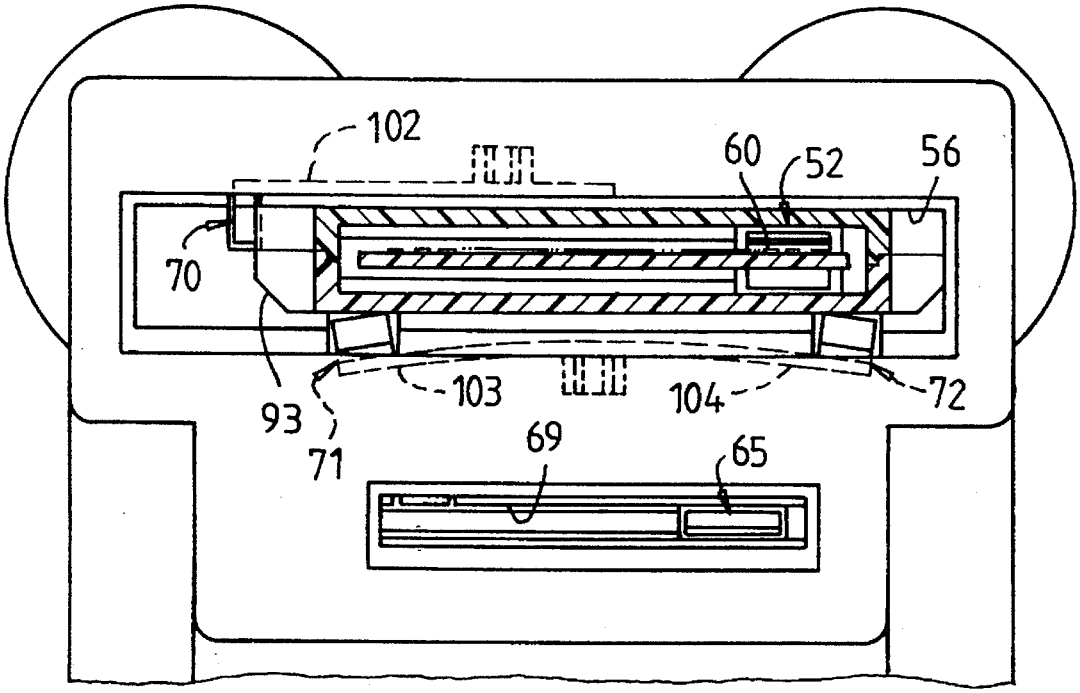
FIG. 14 is a sectional view showing that a third kinds of TV game cassette as shown in FIG. 19 is inserted into the cleaning device of the present invention.
Figure 15:
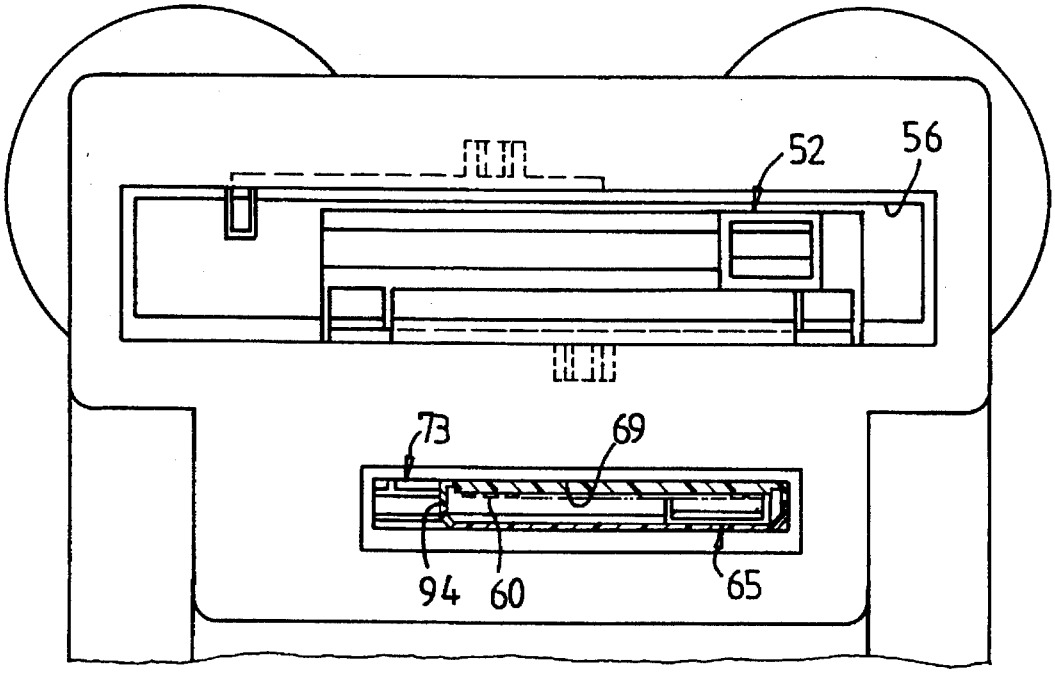
FIG. 15 is a sectional view taken along line 15—15 of FIG. 9, wherein the fourth kinds of TV game cassette of FIG. 20 is inserted into the cleaning device of the present invention.
Figure 16:
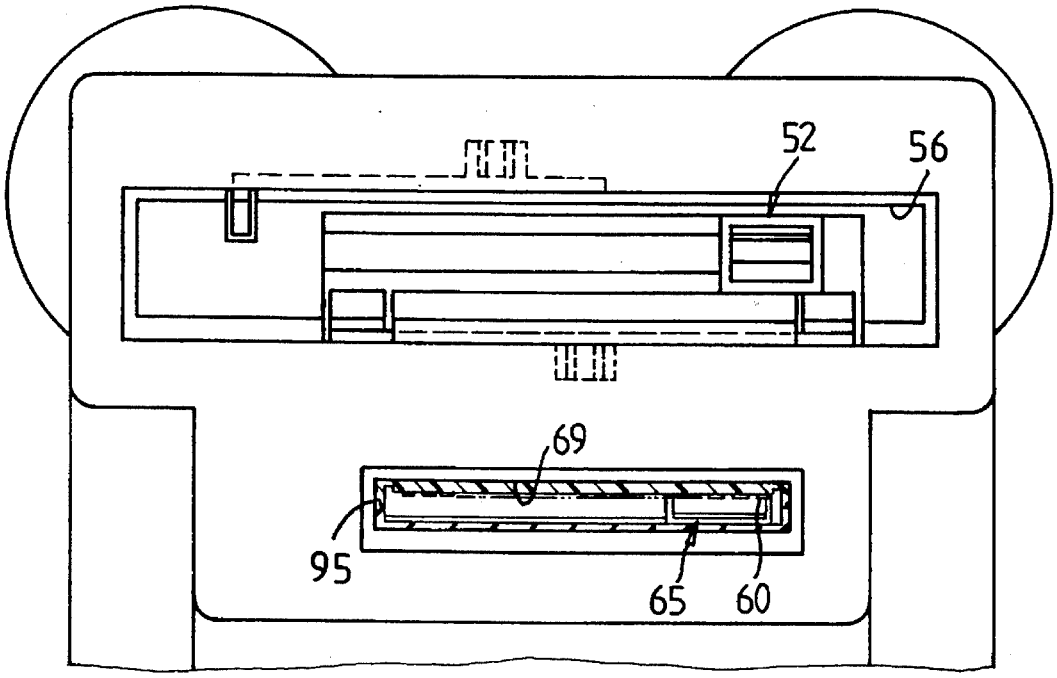
FIG. 16 is a sectional view showing that a fifth kinds of TV game cassette as shown in FIG. 21 is inserted into the cleaning device of the present invention.
Figure 17:
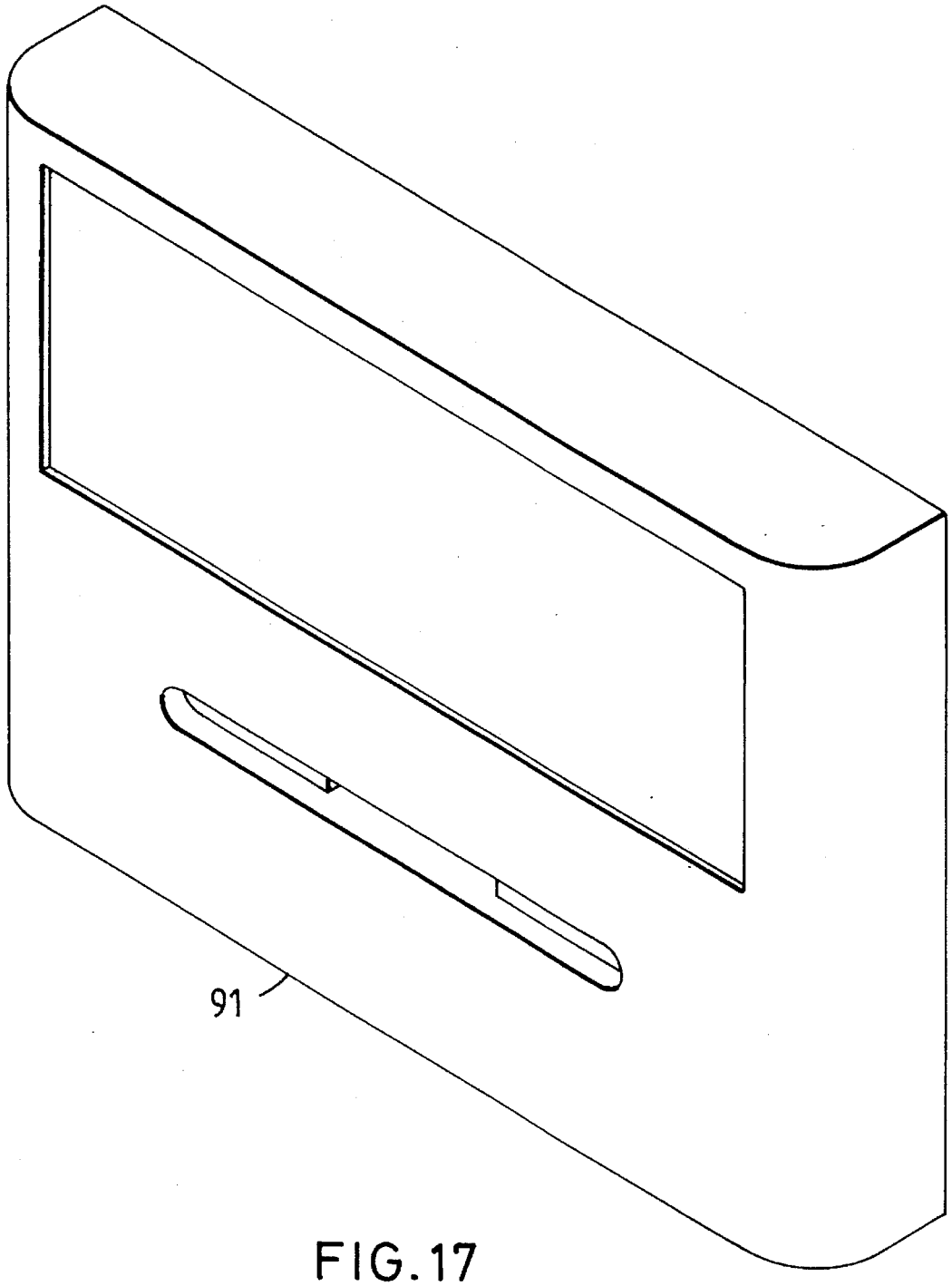
FIG. 17 is a perspective view of the first kinds TV game cassette.
Figure 18:
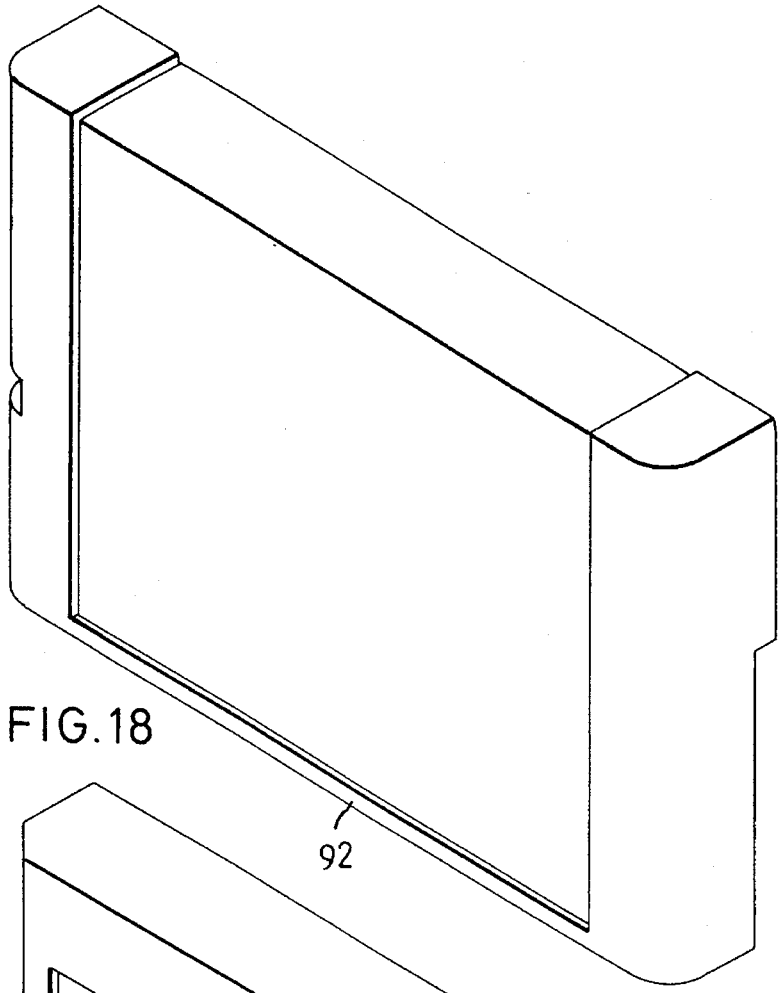
FIG. 18 is a perspective view of the second kinds TV game cassette.
Figure 19:
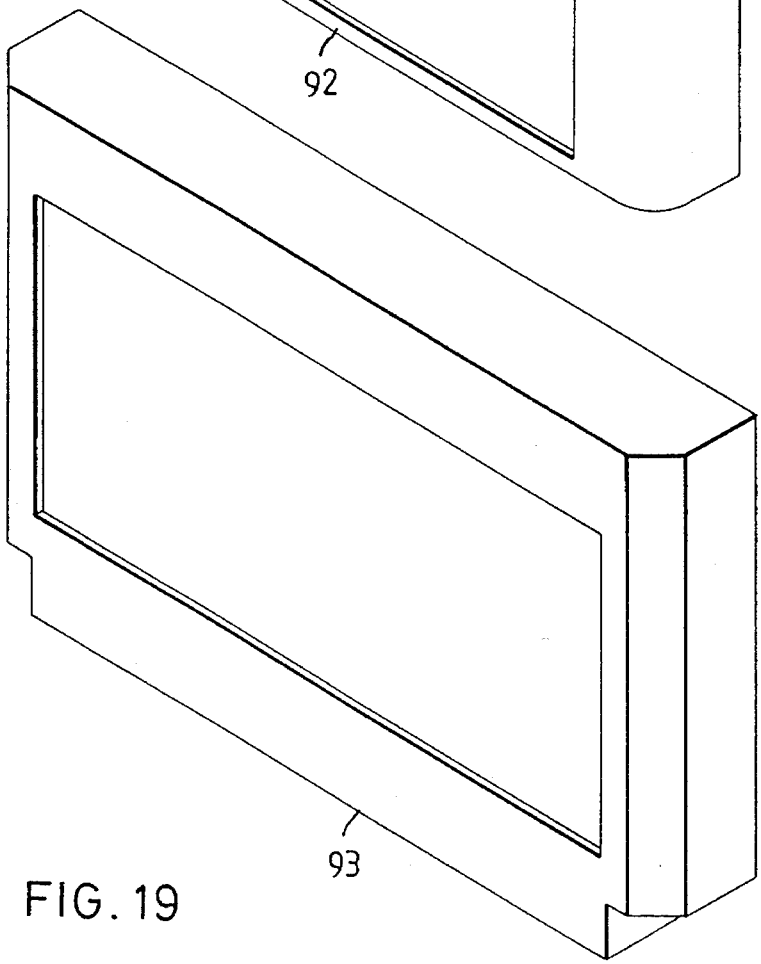
FIG. 19 is a perspective view of the third kinds TV game cassette.
Figure 20:
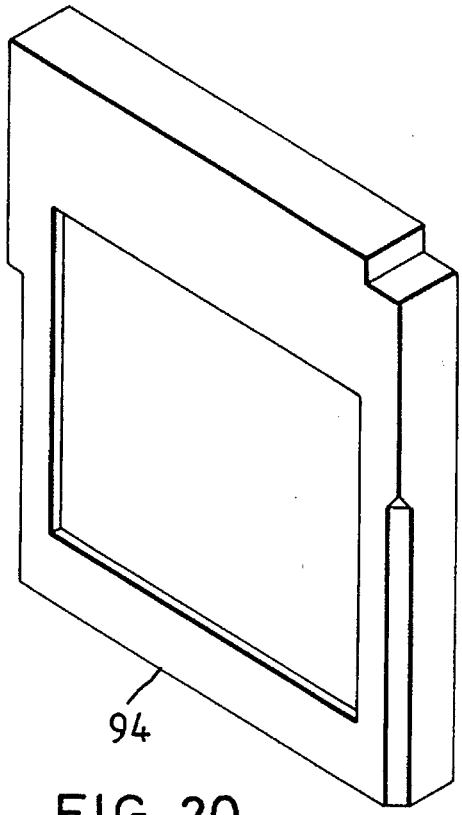
FIG. 20 is a perspective view of the fourth kinds TV game cassette.
Figure 21:
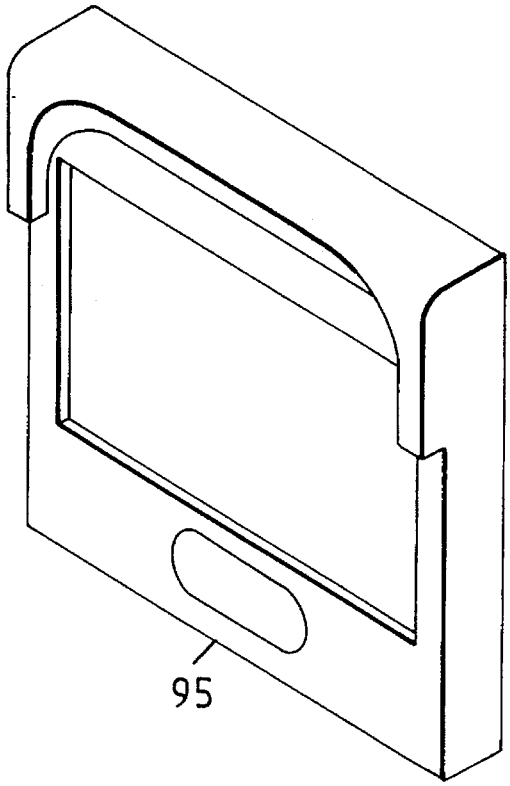
FIG. 21 is a perspective view of the fifth kinds TV game cassette.
Figure 22:
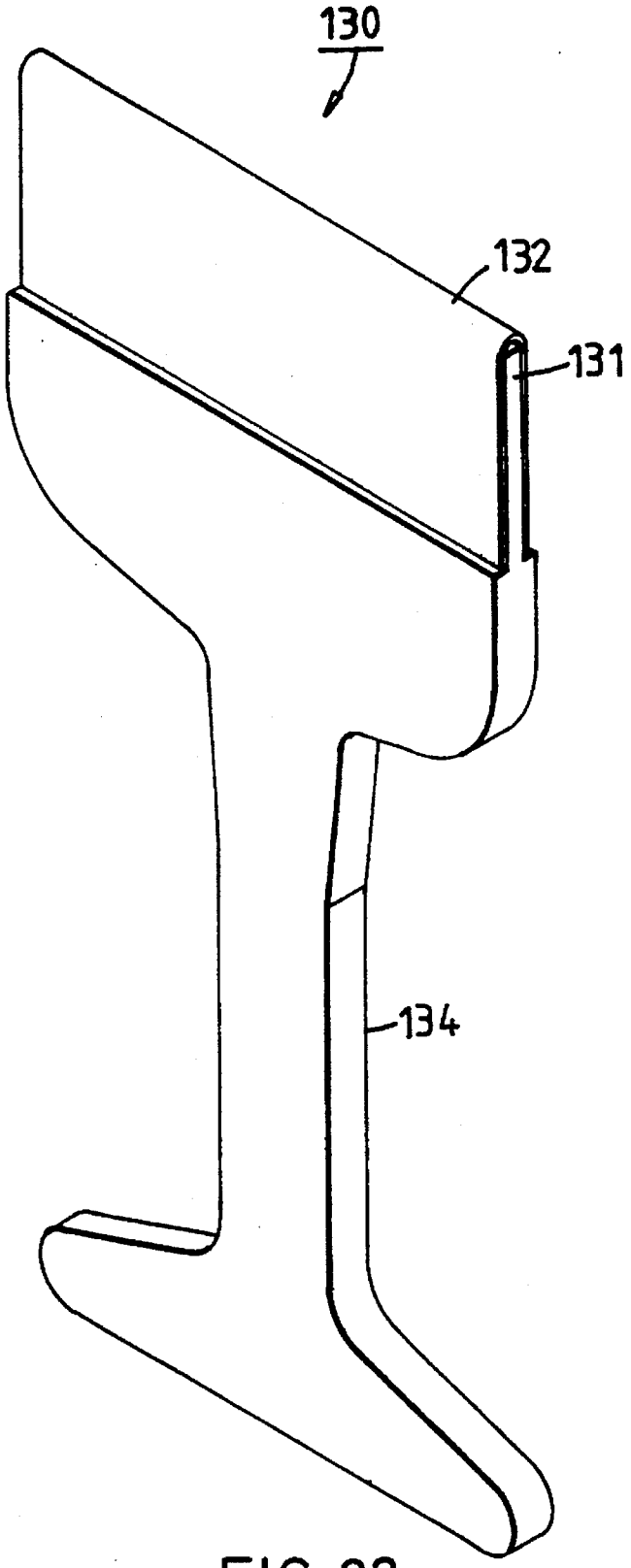
FIG. 22 PRIOR ART
FIG. 22 is a perspective view of a conventional manually operated cleaner for the TV game cassette.

When it is desired to clean the TV game cassette 90 (or 91, 92, 93, 94), the cassette is inserted into the insertion socket 56 or 69 with the contacts 60 of the cassette faced downward as shown in FIGS. 8 and 12. Then the depression key 106 is pressed downward to through the cleaning arm 53 press down the cam 79 and the gear 123. After the cam 79 is depressed, the driving section 64 thereof is moved downward and separated from the recess 85. Meanwhile, the large diameter rim portion 81 of the cam 79 is moved downward to shift the resilient contact 125 of the Switch 78 toward the other resilient contact 126, whereby the two contacts 125, 126 contact with each other to power on the motor 55. Accordingly, the motor 55 rotates to sequentially drive the spiral rod 114, spiral wheel 115 and gears 116, 117, 118 and 119 and further through the gear 119 and driving shaft 110 drive the cam 79 to rotate.

By means of the rotation of the driving section 64, the cam 79 drives the cleaning arm 53 to move along the two slide slots 90, 101 and simultaneously drive the two pin members 108, making the cleaning assemblies 52, 65 reciprocally slide respectively along the linear guide rails 61, 107 at the same time so as to back and forth clean the contacts 60 of the TV game cassette 90 as shown in FIGS. 8 and 12.

After the cam 79 is pressed down, through the gear 119 the gears 121,122 are further driven in sequence to make the gear 123 rotate at relatively slow speed. Once the cam 79 rotates, the driving section 64 separates from the recess 85 and continuously rotates under and along the annular projection 84. Meanwhile, the lifting section 100 of the gear 123 is also pressed down by the cam 79 to separate from a hole 129 of a board member 127. The lifting section 100 of the gear 123 has an inclined face 128 so that once the gear 123 rotates, the inclined face 128 contacts with the wall of the hole 129 to make the lifting section 100 completely separated from the hole 129. Once the lifting section 100 of the gear 123 is separated from the hole 129, the lift section 100 continuously rotates along with the gear 123 and contacts with the bottom face of the board member 127 to compress the spring 83, whereby during the cleaning operation, the spring 83 is prevented from bounding upward to lift the cam 79 and interrupt the cleaning operation.

When the cleaning operation is completed, the lifting section 100 finishes its rotation through one circle and moves back to the position under the hole 129. At this time, the driving section 64 is right aligned with the recess 85 and the spring 83 lifts the gear 123 and the cam 79 at the same time. Accordingly, the small diameter rim portion 82 of the cam 79 is moved upward and aligned with the switch 78 to separate the resilient contacts 125, 126 thereof and cut off the power for the motor 55 and thus terminate the cleaning operation.

It is to be understood that the above description and drawings are only used for illustrating one embodiment of the present invention, not intended to limit the scope thereof. Any variation and derivation from the above description and drawings should be included in the scope of the present invention.

What is claimed is:

1. An automatic cleaning device for TV game cassette contact portions comprising:

a housing composed of an upper case and a lower case, said upper case including at least one insertion socket formed on a surface thereof, whereby the cassette can be inserted and located in said at least one insertion socket, and at least one linear guide rail formed in said housing corresponding to said at least one insertion socket;

a cleaning assembly slidably disposed on said at least one guide rail, said cleaning assembly being able to reciprocally slide along said at least one guide rail to reciprocally clean the contact portions of the cassette;

a cleaning arm having one end pivotally disposed in said housing and another end slidably connected with said cleaning assembly, said cleaning arm being formed with a plurality of slide slots;

a crank having a rotary center and a driving section, said rotary center being rotatably disposed in said housing, said driving section being slidably connected with one of said slide slots of said cleaning arm, whereby by means of rotational movement of said crank, said cleaning arm is driven to reciprocally swing about said pivotally disposed end so as to drive said cleaning assembly to reciprocally move along said at least one guide rail; and a motor disposed in said housing for driving said crank to rotate.

2. A cleaning device as claimed in claim 1, wherein said housing includes two insertion sockets for different types of TV game cassettes to insert thereinto.

3. A cleaning device as claimed in claim 2, wherein locating tenons are disposed in at least one of said insertion sockets, said locating tenons being positioned in said housing and extended into at least one of said insertion sockets for engaging with at least one end of a relatively small TV game cassette, said locating tenons having inclined sides, whereby a relatively large TV game cassette can press said inclined sides of said locating tenons to retract said locating tenons into said housing, so that the larger TV game cassette can be smoothly inserted into at least one of said insertion sockets and securely located therein by means of a tightening effect provided by said locating tenons.

4. A cleaning device as claimed in claim 3, wherein said locating tenons have resilient portions integrally formed on said locating tenons, one of said resilient portions being fixed in said housing, making said locating tenon resiliently biased toward said at least one insertion socket.

5. A cleaning device as claimed in claim 4, further comprising a cleaning time setting means including:

a switch fixedly disposed in said housing for controlling activation/stopping of said motor;

a cam rotatably disposed in said housing and adjacent to said switch for controlling closing/opening thereof; and a transmission gear disposed between said cam and said crank for setting rotary speed ratio therebetween.

6. A cleaning device as claimed in claim 5, wherein said cam is disk-like and disposed on said crank, having a large diameter rim portion and a small diameter rim portion, a spring being disposed between said cam and said lower case for lifting said cam.

7. A cleaning device as claimed in claim 6, wherein on a bottom of said upper case is formed an annular projection corresponding to a rotational track of said crank, a recess being formed on said annular projection, whereby said driving section of said crank is able to upward abut against said projection to force said crank and cam to move downward so that said large diameter rim portion of said cam can trigger said switch, said recess of said projection permitting said driving section of said crank to slide thereinto, whereby by means of said spring, said cam and said crank are lifted to make said small diameter rim portion of said cam aligned with said switch so as to cut off power for said motor and thus rest said cleaning assembly at ends of the guide rails.

8. A cleaning device as claimed in claim 7, wherein said transmission gear has a lifting portion for lifting or lowering said cam and said driving section.

9. A cleaning device as claimed in claim 1 or 7, wherein said cleaning arm includes two arm members pivotally connected with each other and a torsion spring disposed between said two arm members, whereby said cleaning arm is folded for relatively short travel cleaning operation and unfolded for relatively long travel cleaning operation.

10. A cleaning device as claimed in claim 1, 2, 3, 4, 5, 6 or 7, wherein said cleaning assembly is a brush made of hairs.

* * * * *